United States Patent [19]

Fujishita et al.

[11] Patent Number: 4,560,734

[45] Date of Patent: Dec. 24, 1985

[54] POLYPROPYLENE FIBERS HAVING IMPROVED HEAT-SHRINKABILITY AND TENACITY

[75] Inventors: Kusuo Fujishita, Moriyama; Hideshi Sakamoto, Ichihara, both of Japan

[73] Assignee: Chisso Corporation, Ohsaka, Japan

[21] Appl. No.: 529,997

[22] Filed: Sep. 7, 1983

[30] Foreign Application Priority Data

Sep. 7, 1982 [JP] Japan ..... 57-155752

[51] Int. Cl.[4] ..... C08F 4/64

[52] U.S. Cl. ..... 526/142; 526/348.1; 526/351; 264/176 F; 264/289.6; 264/DIG. 28; 264/DIG. 73

[58] Field of Search ..... 526/348.1, 351, 142; 264/176 F, 289.6, 290.5, DIG. 28, DIG. 73

[56] References Cited

U.S. PATENT DOCUMENTS

| | | | |
|---|---|---|---|
| 3,054,652 | 9/1962 | Heumann | 526/348.1 |
| 3,106,442 | 10/1963 | Compostella et al. | 264/290.5 X |
| 3,152,380 | 10/1964 | Martin | 264/289.6 X |
| 3,413,397 | 11/1968 | Bierbaum et al. | 264/290.5 X |
| 3,705,227 | 12/1972 | Fintel et al. | 264/176 F |
| 4,283,463 | 8/1981 | Shiga et al. | 526/348.1 |
| 4,499,247 | 2/1985 | Chiba et al. | 526/142 |

*Primary Examiner*—Joseph L. Schofer
*Assistant Examiner*—Fred M. Teskin
*Attorney, Agent, or Firm*—Beall Law Offices

[57] ABSTRACT

Polypropylene fibers having a much improved percentage heat shrinkage and also an improved tenacity are provided, which fibers comprise a polypropylene resin having a density of 0.905 or more, an isotactic pentad ratio of boiling n-heptane-insoluble portion ($P_0$) of 0.960 or more and a ratio of pentad having two different kinds of configurations ($P_2$), of 0.002 (0.2%) or less.

12 Claims, 5 Drawing Figures

POLYPROPYLENE FIBERS HAVING IMPROVED HEAT-SHRINKABILITY AND TENACITY

BACKGROUND OF THE INVENTION

1. Field of the Invention

This invention relates to polypropylene fibers having an improved heat-shrinkability and tenacity. More particularly it relates to polypropylene fibers produced from a specified polypropylene resin and having an improved tenacity and an improved shrinkability in a heated atmosphere.

2. Description of the Prior Art

In general, fibers consisting of polypropylene resin have been first prepared by melt-extruding the resin through various shapes of die, then processed into filaments, staple fibers, flat yarns, etc. via stretching step, heat-treatment step, etc., and further secondarily processed into waddings, carpet piles, non-woven fabrics, industrial materials, striped fabrics, cloth-like products, etc.

Fibers consisting of polypropylene resin have suitable tenacity characteristics imparted by orientation-crystallization during their spinning and stretching steps and have been used for practical uses, but they have such drawbacks that their tenacity is liable to be reduced and their shrinkage is liable to occur.

Thus in order to prevent shrinkage of their products with increase of time when they are preserved and used at room temperature, the fibers have been usually subjected to relaxation heat treatment at a temperature lower than the melting point of polypropylene after their stretching, to remove their internal strain formed when they are oriented during the spinning and stretching steps, i.e. their residual stress, which is a cause of the shrinkage and promote recrystallization to thereby stabilize the shrinkage. On the other hand, in order to make up the fibers into products, various secondary processings are required, and in the case of some products, the fibers are often subjected to various processes exposed to an atmosphere at higher temperatures than room temperature; in particular, at higher temperatures than the heat treatment temperature, there occurs retrogradation of the orientation at the time of spinning and stretching whereby the shrinkage is rapidly increased.

Referring to flat yarns used as a primary backing of carpets, for example in the case of tufted carpets, polypropylene fibers are tufted on the backing and backed with a latex, followed by a latex-drying step; hence the fibers are exposed to a heated atmosphere at considerably high temperatures. Further, recently there is a tendency that the latex-drying step is carried out at higher temperatures and higher speeds to improve the productivity of the products. For example, when the fibers are allowed to stand at 130° C. for 15 minutes, if they have a heat-shrinkability endurable to the conditions, no problem has so far been raised, but a heat-shrinkability endurable to higher temperatures than such a temperature has recently come to be required.

In order to obtain a low heat-shrinkability under heating, i.e. the so-called low shrinkage, relaxation annealing may be generally applied after stretching, as described above, but the percentage relaxation has so far been generally 10 to 25%; if the percentage exceeds such values, a problem is raised that the productivity is reduced as much as the increase in the percentage relaxation.

Further, the percentage heat shrinkage of flat yarns is said to depend on the shrinkage of their noncrystallized portion caused by crystallization under heating, the recovery of the internal strain formed at the time of orientation by stretching and the retrogradation of the orientation. Thus, there has been employed a process of crystallizing the film prior to stretching as much as possible or subjecting the film after stretched to relaxation annealing to thereby effect removal of the internal strain and recrystallization. As for the process for advancing the crystallization of the film prior to stretching, as far as the aspect of processing is concerned, slow cooling is suitable for cooling the film just after extruded; hence air cooling manner is more advantageous than water cooling manner, and in the case of water cooling manner, cooling has been advantageiously carried out at a relatively high temperature of water. As far as the aspect of raw material is concerned, as for a process for enhancing the crystallization of the film or unstretched yarns, there has been employed a process of adding an organic nucleus-creating agent such as p-tertiary-butyl benzoic acid aluminum salt, dibenzylidene sorbitol, etc. to a conventional polypropylene resin. However, even though the above-mentioned processes are employed and further a relaxation annealing is added thereto, improvement in the heat-shrinkability at high temperatures, higher than 130° C. cannot be observed.

SUMMARY OF THE INVENTION

The object of the present invention is to provide polypropylene fibers having a superior heat-shrinkability and excellent mechanical properties such as tenacity. The present inventors have made strenuous studies on the above-mentioned problems, and have found that when a polypropylene having a density of 0.905 or more, an isotactic pentad ratio of boiling n-heptane-insoluble portion (Po) of 0.960 or more and a ratio of pentad having two different kinds of configurations ($P_2$), of 0.002 or less is used as the raw material for polypropylene fibers, it is possible to improve the heat-shrinkability of the polypropylene fibers in the direction in which it is reduced to a large extent.

The present invention resides in:

Polypropylene fibers having an improved heat-shrinkability and tenacity, which comprise a polypropylene resin having a density of 0.905 or more, an isotactic pentad ratio of boiling n-heptane-insoluble portion (Po) of 0.960 or more and a ratio of pentad having two different kinds of configurations ($P_2$), of 0.002 (0.2%) or less.

DETAILED DESCRIPTION OF THE INVENTION

Figure 1:
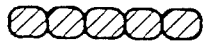
FIG. 1 shows a laterally cross-sectional view of an example of connected yarns.

Polypropylene used in the present invention can be prepared according to the process described in the specification of Japanese patent application No. Sho 56-204066/1981, by polymerizing propylene in the presence of a catalyst prepared by reacting an organoaluminum compound or a reaction product of an organoaluminum compound with an electron donor, with $TiCl_4$, further reacting the resulting solid product (II) with an electron donor and an electron acceptor, and then combining the resulting solid product (III) with an organoaluminum compound and an aromatic carboxylic acid ester (V), the molar ratio of (V) to (III) being 0.2 to 10.0.

More particularly, the disclosure of the above-named Japanese patent application relates to:

(1) a polypropylene capable of producing high-rigidity molded products obtained by polymerizing propylene in the presence of a catalyst prepared by reacting an organoaluminum compound (I) or a reaction product (VI) of an organoaluminum compound (I) with an electron donor (A), with $TiCl_4$ (C), further reacting the resulting solid product (II) with an electron donor (A) and an electron acceptor (B), and them combining the resulting solid product (III) with an organoaluminum compound (IV) and an aromatic carboxylic acid ester (V), the molar ratio of said aromatic carboxylic acid ester to said solid product (III) being in the range of 0.2 to 10.0;

(2) a polypropylene according to the above item (1) wherein said organoaluminum compound (IV) is a dialkylaluminum monohalide;

(3) a process for producing a polypropylene according to the above item (1) wherein said catalyst is further preactivated by reacting an -olefin with a combination of said solid product (III) with an organoaluminum compound (IV); and (4) a polypropylene according to the above item (1), which has an isotactic pented ratio (P) relative to MFR in the range of $1.00 \geqq P \geqq 0.015 \log MFR + 0.955$;

in a second aspect, (5) a process for producing a polypropylene which comprises polymerizing propylene in the presence of a catalyst prepared by reacting an organoaluminum compound (I) or a reaction product (VI) of an organoaluminum compound (I) with an electron donor (A), with $TiCl_4$(C), further recording the resulting solid product (II) with an electron donor (A) and an electron acceptor (B), and them combining the resulting solid product (III) with an organoaluminum compound (IV) and an aromatic carboxylic acid ester (V), the molar ratio of said aromatic carboxylic acid ester to said solid product (III) being in the range of 0.2 to 10.0;

(6) a process for producing a polypropylene according to the above item (5), wherein said organoaluminum compound (IV) is a dialkylaluminum monohalide;

(7) a process for producing a polypropylene according to the above items (5), wherein said catalyst is further preactivated by reacting an α-olefin with a combination of said solid product (III) with an organoaluminum compound; and (8) a process for producing a polypropylene according to the above item (5), which has an isotactic pentad ratio (P) relative to MFR in the range of $1.00 \geqq P \geqq 0.015 \log MFR + 0.955$.

Physical properties of such materials are as follows:

Methods of measuring physical properties of injection molded products;

Bending modulus: according to JIS K 6758 ($Kgf/cm^2$)

Bending strength: according to JIS K 6758 ($Kgf/cm^2$)

Tensile strength: according to JIS K 6758 ($Kgf/cm^2$)

Hardness (Rockwell): according to JIS K 6758 (R-scale)

Heat deformation temperature (HDT): according to JIS K 7202 (°C.)

Method of meansuring physical properties of films:

Young's modulus: according to ASTM D 888 ($Kgf/mm^2$)

Tensile yield strength: according to ASTM D 882 ($KGF/mm^2$)

(In Examples, the above Young's modulus and tensile yield strength are shown in terms of the average value of TD and MD.)

Haza: according to ASTM D 1003 (%)

Punching impact strength: according to ASTM D 781 ($Kgf/cm^2$)

MFR: according to ASTM D 1238 (g/10 min.), 230° C., 2.16 Kg Isotactic pentad ratio (P);

This is measured based on Macromolecules 8 687 (1975), and refers to an isotactic ratio in terms of pented units in polypropylene molecule chain, measured using $^{13}C$-NMR. Successive extractions:

This is carried out by adding a small amount of a heat stabilizer (e.g. 0.1 part of 2,6-di-t-butyl-p-cresol) to 100 parts of polypropylene powder, granulating them by means of an extruder, milling by means of a mill, sieving by means of 20 mesh sieve, and extracting 3 g of the resulting 20 mesh pass with boiling n-hexane (100 ml) for 6 hours and successively with boiling n-heptane (100 ml) for 6 hours, by means of a Soxhlet extractor.

TABLE A

| | Polymerization conditions and results and physical properties of injection molded products (I) | | | | | | | |
|---|---|---|---|---|---|---|---|---|
| | Example | | | Comparative example | | | | |
| | 1 | 2 | 3 | 1 | 2 | 3 | 4 | 5 |
| Mol ratio of aromatic ester/solid product* | 1.0 | 1.0 | 1.0 | 0.5 | 0.5 | 0.0 | — | 1.0 |
| Kind of catalyst | For present invention | | | AA Type | | | Supported type | Org. Al-reduced type |
| Polypropylene yield (Kg) | 45.5 | 46.5 | 44.0 | 41.5 | 40.5 | 39.5 | 42.5 | 43.5 |
| MFR | 2.5 | 10.6 | 34.0 | 2.7 | 9.8 | 36.5 | 4.3 | 9.4 |
| Amount of $C_6 + C_7$ extracts (%) | 2.8 | 3.2 | 3.5 | 4.2 | 4.5 | 5.1 | 8.0 | 4.1 |
| Isotactic pentad ratio | | | | | | | | |
| P Total | 0.972 | 0.981 | 0.990 | 0.922 | 0.935 | 0.948 | 0.915 | 0.955 |
| P n-$C_6$ extract | 0.516 | 0.587 | 0.654 | 0.286 | 0.244 | 0.297 | 0.152 | 0.312 |
| P n-$C_7$ extract** | 0.775 | 0.846 | 0.893 | 0.577 | 0.598 | 0.681 | 0.547 | 0.693 |

TABLE A-continued

| Polymerization conditions and results and physical properties of injection molded products (I) | Example | | | Comparative example | | | | |
|---|---|---|---|---|---|---|---|---|
| | 1 | 2 | 3 | 1 | 2 | 3 | 4 | 5 |
| Bending modulus | 17,200 | 18,300 | 19,200 | 12,100 | 13,600 | 15,000 | 11,700 | 15,600 |
| Bending strength | 465 | 488 | 510 | 350 | 383 | 410 | 338 | 425 |
| Tensile strength | 370 | 378 | 385 | 325 | 337 | 348 | 320 | 355 |
| Hardness | 111 | 115 | 117 | 100 | 103 | 104 | 99 | 104 |
| HDT | 118 | 121 | 123 | 101 | 105 | 110 | 100 | 110 |

TABLE B

| Polymerization conditions and results and physical properties of injection molded products (II) | Example | | | Comparative example A | | |
|---|---|---|---|---|---|---|
| | 4 | 5 | 6 | 6 | 7 | 8 |
| Mol ratio of aromatic ester/solid product* | 0.5 | 2.0 | 5.2 | 0.0 | 0.05 | 15 |
| Kind of catalyst component | For present invention | | | | | |
| Polypropylene yield (Kg) | 28.5 | 26.0 | 9.0 | 34.5 | 32.5 | 2.5 |
| MFR | 18.2 | 8.7 | 6.2 | 37 | 26 | 10.4 |
| Amount of $C_6 + C_7$ extracts (%) | 4.7 | 2.5 | 2.1 | 9.2 | 6.6 | 4.2 |
| Isotactic pentad ratio | | | | | | |
| P Total | 0.972 | 0.981 | 0.985 | 0.955 | 0.960 | 0.981 |
| P n-$C_6$ extract | 0.516 | 0.587 | 0.614 | 0.291 | 0.345 | 0.574 |
| P n-$C_7$ extract** | 0.775 | 0.846 | 0.860 | 0.710 | 0.712 | 0.835 |
| Bending modulus | 17,800 | 19,100 | 18,800 | 15,300 | 16,100 | — |
| Bending strength | 470 | 502 | 498 | 425 | 435 | — |
| Tensile strength | 376 | 383 | 380 | 350 | 355 | — |
| Hardness | 112 | 116 | 115 | 103 | 104 | — |
| HDT | 118 | 120 | 118 | 109 | 110 | — |

Note:
*Methyl toluylate was used.
**n-$C_6$ extract was successively extracted.
A: Mol ratios of aromatic ester to solid product are outside the range of the present invention.

TABLE C

| Polymerization conditions and results and physical properties of injection molded products (III) | Example No. | | | | | | | | | | |
|---|---|---|---|---|---|---|---|---|---|---|---|
| | 7 | 8 | 9 | 10 | 11 | 12 | 13 | 14 | 15 | 16 | 17 |
| Kind of aromatic ester* | a | a | a | a | a | b | c | d | e | f | g |
| Kind of organoaluminum compound** | i | i | ii | iii | iv | i | i | i | i | i | i |
| Polypropylene yield (Kg) | 45.1 | 37.5 | 42.0 | 47.3 | 40.5 | 42.4 | 39.8 | 32.2 | 31.9 | 44.0 | 44.3 |
| MFR | 11.0 | 12.6 | 30.6 | 26.2 | 28.3 | 13.5 | 14.9 | 17.5 | 18.4 | 15.1 | 17.6 |
| amount of $C_6 + C_7$ extracts (%) | 3.4 | 4.1 | 4.0 | 3.6 | 2.1 | 2.3 | 3.6 | 4.1 | 4.4 | 3.7 | 3.5 |
| Isotactic pentad ratio | | | | | | | | | | | |
| P Total | 0.977 | 0.973 | 0.985 | 0.986 | 0.992 | 0.983 | 0.977 | 0.975 | 0.373 | 0.979 | 0.980 |
| P n-$C_6$ extract | 0.564 | 0.512 | 0.610 | 0.604 | 0.651 | 0.615 | 0.550 | 0.524 | 0.487 | 0.579 | 0.583 |
| P n-$C_7$ extract** | 0.819 | 0.783 | 0.855 | 0.862 | 0.893 | 0.837 | 0.821 | 0.818 | 0.792 | 0.830 | 0.825 |
| Bending modulus | 17,900 | 17,100 | 18,800 | 18,600 | 19,400 | 18,200 | 17,900 | 17,600 | 17,500 | 18,000 | 18,100 |
| Bending strength | 483 | 472 | 494 | 492 | 516 | 492 | 484 | 480 | 477 | 486 | 490 |
| Tensile strength | 377 | 370 | 382 | 381 | 389 | 378 | 373 | 372 | 365 | 374 | 381 |
| Hardness | 114 | 111 | 116 | 115 | 118 | 115 | 114 | 114 | 113 | 114 | 115 |
| HDT | 120 | 117 | 120 | 121 | 123 | 119 | 119 | 118 | 117 | 119 | 120 |

Note:
*a, b and c represent methyl, ethyl and butyl p-toluylate, respectively; d and e, methyl and ethyl benzoate, respectively; and f and g, methyl and ethyl p-anisate, respectively.
**i, ii and iii represent diethyl-, di-n-propyl- and di-i-butylaluminum monochloride, respectively, and iv represents diethylaluminum monoiodide.

Isotactic pentad ratio referred to herein means an isotactic pentad ratio in terms of pentad units in the molecular chain of polypropylene, measured by using $^{13}$C-NMR (see A. Zambelli et al, Macromolecules 6, 925 (1973)). In other words, the isotactic pentad ratio refers to a ratio of five continuously and isotactically connected propylene monomer units in total propylene monomer units. The peak-assigning method in the above measurement by means of NMR was carried out based on Macromolecules 8 687 (1975). In addition, the measurement by means of NMR was carried out by using an apparatus of FT-NMR at 270 MHZ, and by improving the signal detection limit up to an isotactic pentad ratio of 0.001, by an integrating measurement of 27,000 times.

As to pentad, (1) an isotactic pentad is expressed by mmmm (00000) or (11111); (2) a pentad having one different configuration is expressed by either one of mmmr (00001) or (11110), mmrr (00010) or (11101), or mrrm (00100) or (11011); and (3) a pentad having two different kinds of configurations is expressed by mmrm (00011) or (11100), mrrr (00101) or (11010), mrmr (00110) or (11001), rrmr (01001) or (10110), rrrr (01010) or (10101) or rmmr (01110) or (10001), wherein m represents an isotactic dyad; r represents a syndiotactic dyad; and 0 and 1 each represents an individual monomer unit configuration along the polymer chain, and 0 represents a configuration while 1 represents a reverse configuration.

The boiling n-heptane-insoluble portion of polypropylene used in the present invention refers to an extraction residue obtained by wholely dissolving 5 g of polypropylene in 500 ml of boiling xylene, pouring the solution in 5 l of methanol, recovering the resulting precipitate, drying it and extracting it with boiling n-heptane by means of a Soxhlet extractor for 6 hours. The density was determined by preparing a sample according to the press method of JIS K 6758 and measuring it according to the underwater replacement method of JIS K 7112.

A polypropylene having an isotactic pentad ratio of boiling n-heptane-insoluble portion ($P_0$) less than 0.960 is insufficient in the effectiveness of improving the heat shrinkage. Further, the density of polypropylene subjected to no treatment such as extraction, is preferably 0.905 or higher, more preferably 0.910 or higher. If it is lower than such values, the effectiveness of improving the heat shrinkage is also insufficient. Further, if the ratio of pentad having two different kinds of configurations ($P_2$) exceeds 0.002, the effectiveness of improving the heat shrinkage is also insufficient.

The polypropylene used in the present invention has a higher melting point by 2° C. or more than those of conventional polypropylene and also a much higher degree of crystallization. This is shown by measurement by means of e.g. DSC (differential scanning calorimeter). Further, the polypropylene has a higher crystallization rate from its molten state than those of conventional products; for example, the growth rate of its spherulites is higher and the number of its spherulite nuclei generated is larger. The fact that the polypropylene has a higher degree of crystallization and a much higher crystallization rate than those of conventional polypropylene is considered to be the cause of achievement of the improved heat shrinkage according to the present invention.

The polypropylene used in the present invention may, if necessary, contain an additive such as heat stabilizers, antioxidant, UV absorber, antiblocking agent, coloring agent, etc. Further, when a nucleus-creating agent is added, a somewhat improvement in the heat-shrinkability is observed.

The polypropylene fibers referred to herein mean collectively products obtained by melt-spinning or extruding the above-mentioned polypropylene, such as filaments, staple fibers, yarns of various shaped section, tows, flat yarns, stretched yarns, unstretched yarns, heat-treated yarns, secondarily processed products of the foregoing, etc. The above-mentioned flat yarns include those of 100 to 2000 deniers used for fabrics having a rectangular section, connected yarns of shaped section such as circular section or elliptical section having a plurality of single filaments connected in parallel (see FIG. 1), ribbed tapes (see FIG. 2), etc.

As for the spinning, stretching, heat treatment, etc. and apparatus therefore employed in the production of polypropylene fibers of the present invention, conventional ones may be applied. For example, flat yarns having an improved heat-shrinkability can be generally obtained by the following process: the melt flow rate (MFR) of polypropylene used in this case is suitably in the range of 1.0 to 7.0. If it is less than 1.0, extrusion property and stretchability are inferior, while it exceeds 7.0, the resulting flat yarn is liable to split in the direction of its stretching axis, resulting in reduction of loom-operating efficiency.

A polypropylene having a density of 0.905 or more, an isotactic pentad ratio of boiling n-heptane-insoluble portion ($P_0$) of 0.960 or more and a ratio of pentad having two different kinds of configurations ($P_2$), of 0.002 (0.2%) or less, is melted and kneaded by means of a conventional extruder, extruded from a T die, a circular die or the like, and cooled by means of e.g. chilled roll, dipping in a water tank, air cooling, etc. to make a film, which is then slit and stretched under heating by means of heated roll, hot air oven, infrared ray heater, steam, etc. The stretch ratio may be those employed conventionally. The resulting material is heated in a similar heating manner to that in the case of streching to effect relaxation annealing. In this case, the percentage relaxation is preferably about 5 to 40%. The flat yarn thus obtained has a far less heat shrinkage than those of products obtained from conventional polypropylene resin in the same production manner as above. A remarkable difference is observed particularly in a high temperature region of 130° C. or higher, for example 130° C. to 155° C. Thus, in order to obtain a heat-shrinkability to the same extent as in the case of flat yarn obtained by using conventional polypropylene, a less percentage relaxation is sufficient in the case of the present polypropylene i.e. an advantage of improving the productivility is obtained.

When a fabric is prepared by weaving the thus obtained flat yarns as warps and wefts and this fabric is used as a primary base of carpet, it is possible to obtain a carpet having a small shrinkage and a good quality even when heat treatment is carried out at a high temperature of 130° C. or higher, preferably 130° C. to 155° C., more preferably 130° C. to 150° C. in the production process of carpet.

The present invention will be further described in details by way of Examples.

EXAMPLE 1 AND COMPARATIVE EXAMPLE 1

Figure 2:
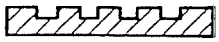
FIG. 2 shows a laterally cross-sectional view of an example of ribbed tapes.

To a polypropylene having a melt flow rate of 3.8, a density of 0.910, an isotactic pentad ratio of boiling n-heptane-insoluble portion of 0.965 and a ratio of pentad having two different kinds of configurations of $<0.002$ were added 0.5% by weight of phenolic stabilizer and 0.1% by weight of calcium stearate, followed by pelletizing. The resulting pellets were melt-extruded by means of an extruder provided with a screw of 40 mm in diameter and a circular die, followed by cooling with a warm water at 40° C. to obtain a tubular film of 50$\mu$ thick, which was then split into tapes of 15 mm wide, followed by stretching them in various ratios in the longitudinal direction, while heating by means of heated rolls having a surface temperature of 140° C. and subjecting to a 15% relaxation heat treatment, while heating by means of two heated rolls having a surface temperature of 140° C. and a hot air oven at 140° C., to obtain flat yarns. Their characteristic values are shown in Table 1 as Example 1. For comparison, to a polypropylene having a melt flow rate of 3.7, a density of 0.900 and an isotactic pentad ratio of boiling n-heptane-insoluble portion of 0.929 and a ratio of pentad having two different kinds of configuration of 0.016 were added the above-mentioned additives, followed by pelletizing as mentioned above. From the resulting pellets of conventional polypropylene resin were prepared flat yarns in the same manner as above. Their characteristic values are shown in Table 1 as Comparative Example 1. Further the percentages heat shrinkage shown in Table 1 are also shown in FIG. 1 wherein numeral 3 shows the case of Example 1 (stretch ratio: 6 times) and numeral 2 shows the case of Comparative Example 1 (stretch ratio: 6 times).

Figure 3:
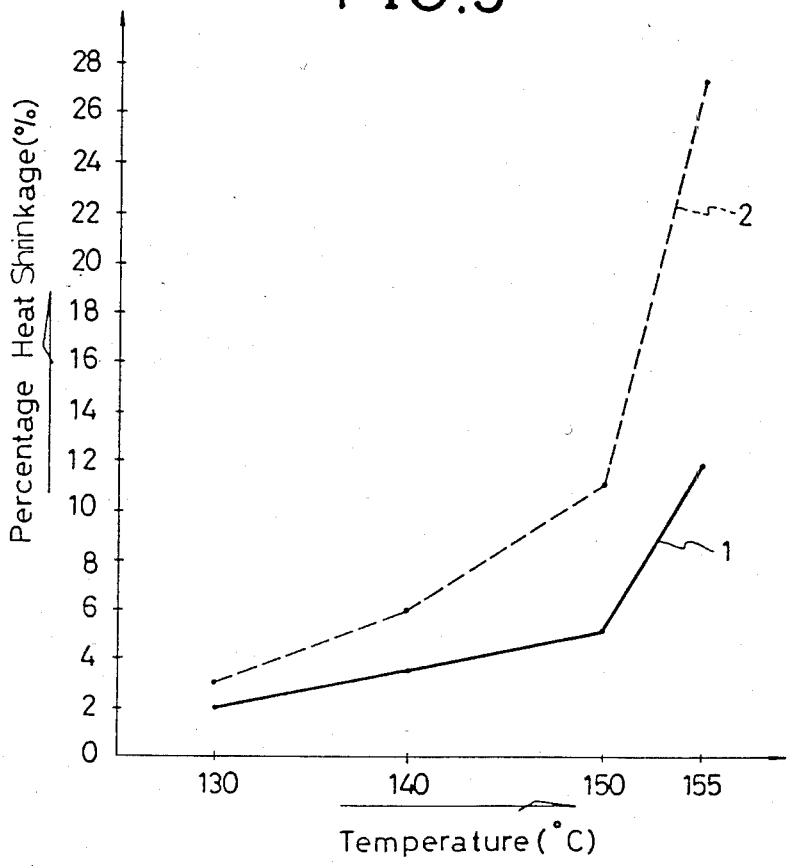
FIG. 3 shows a view of percentages heat shrinkage of flat yarns obtained in Example 1 and Comparative Example 2, at various temperatures.

Flat yarns of the present invention have a less percentage heat shrinkage than that of Comparative Example. As apparent particularly from FIG. 3, a notable difference is observed at high temperature of 150° C. or higher. Nevertheless it is observed that their rigidity (Young's modulus) and tenacity are also high.

EXAMPLES 2–5 AND COMPARATIVE EXAMPLES 2–4

Example 1 was repeated except that only raw materials were varied. The extrusion properties, stretchability and percentage heat shrinkage in a stretch ratio of 6 times of the resulting products are shown in Table 2.

TABLE 1

| Example and Compar. ex. | Extrusion property and stretchability | Stretch ratio Times | Characteristic values of flat yarn: Denier d | Tenacity g/d | Elongation % | 10% Young's modulus g/d | Percentage heat shrinkage (%): 130° C. | 140° C. | 150° C. | 155° C. |
|---|---|---|---|---|---|---|---|---|---|---|
| Example 1 | good | 5.0 | 1394 | 4.59 | 32.0 | 24.1 | 1.7 | 2.5 | 3.3 | 6.1 |
| | | 5.5 | 1242 | 5.29 | 27.0 | 29.6 | 1.9 | 3.1 | 4.3 | 9.4 |
| | | 6.0 | 1157 | 5.83 | 22.0 | 31.8 | 2.0 | 3.5 | 5.2 | 12.0 |
| Compar. ex. 1 | good | 5.0 | 1338 | 4.21 | 39.0 | 18.3 | 1.8 | 3.1 | 5.0 | 20.0 |
| | | 5.5 | 1221 | 5.10 | 30.0 | 25.2 | 2.7 | 5.2 | 10.1 | 25.1 |
| | | 6.0 | 1169 | 5.55 | 25.0 | 28.5 | 2.9 | 6.1 | 11.3 | 27.3 |

TABLE 2

| | Example 2 | Example 3 | Example 4 | Example 5 | Compar. ex. 2 | Compar. ex. 3 | Compar. ex. 4 |
|---|---|---|---|---|---|---|---|
| MFR (g/10 min.) | 1.0 | 2.3 | 4.2 | 7.0 | 1.2 | 4.1 | 6.8 |
| Density (g/cc) | 0.908 | 0.910 | 0.912 | 0.913 | 0.900 | 0.904 | 0.903 |
| $P_0$ | 0.985 | 0.975 | 0.967 | 0.961 | 0.932 | 0.979 | 0.915 |
| $P_2$ | <0.002 | <0.002 | <0.002 | <0.002 | 0.015 | 0.007 | 0.022 |
| Denier (d) | 1067 | 1055 | 1057 | 1043 | 1052 | 1061 | 1058 |
| Percentage heat shrinkage (%) | | | | | | | |
| 130° C. | 2.6 | 2.2 | 2.0 | 1.7 | 5.4 | 3.2 | 3.8 |
| 140° C. | 5.4 | 3.9 | 3.3 | 2.8 | 11.7 | 6.9 | 7.5 |
| 150° C. | 10.3 | 6.3 | 5.2 | 4.7 | 23.1 | 12.4 | 14.3 |
| 155° C. | 18.1 | 13.1 | 11.3 | 8.6 | 34.2 | 27.9 | 29.2 |
| Extrusion property | good | good | good | good | good | good | good |
| Stretchability | good | good | good | good | good | good | good |

As apparent from Table 2, any flat yarns prepared from a polypropylene having a density less than 0.905, a polypropylene having a $P_0$ less than 0.960 and a polypropylene having a $P_2$ greater than 0.002 have a large heat shrinkability, whereas the flat yarns prepared from polypropylene of the present invention have a small heat-shrinkability.

EXAMPLE 6 AND COMPARATIVE EXAMPLE 5

To a polypropylene having a melt flow rate of 5.0, a density of 0.911, an isotactic pentad ratio of boiling n-heptane-insoluble portion of 0.960 and a ratio of pentad having two different kinds of configurations of <0.002 were pelletized. The resulting pellets were melt-extruded from an extruder of 40 mmϕ through 150 nozzles of each a circular section and 0.5 mmϕ in diameter provided therein to obtain unstretched filaments of 15 deniers per filament which were then stretched in various ratios by means of a conventional stretching machine, followed by subjecting them to a 5% relaxation heat treatment while heating with a hot plate at 130° C. to obtain filaments of 3 to 6 deniers/filament. Their tenacity and heat shrinkage values were measured. The results are shown in Table 3.

Figure 4:
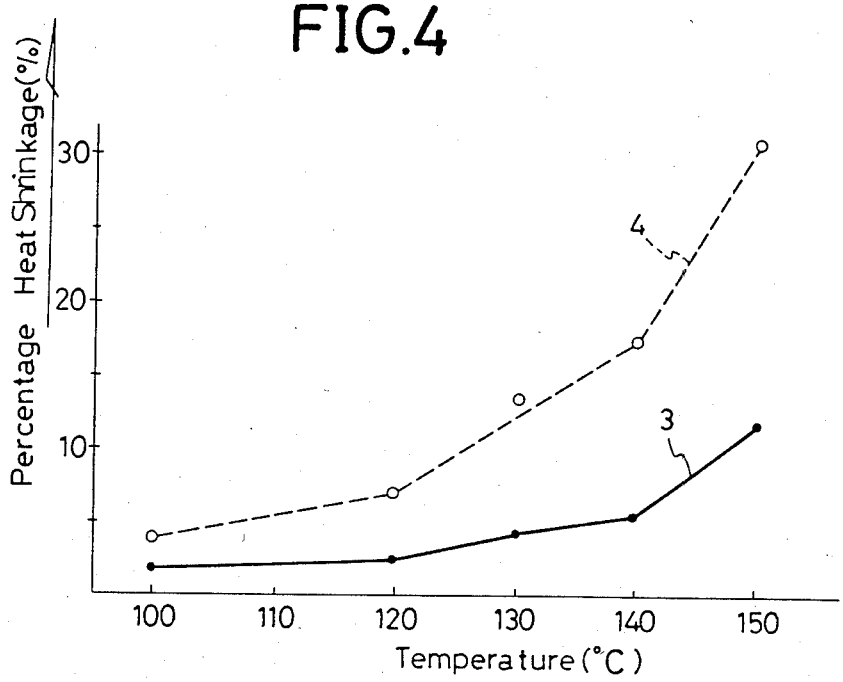
FIG. 4 shows a view of percentages heat shrinkage of stretched yarns obtained in Example 6 and Comparative Example 5, at various temperatures.
Figure 5:
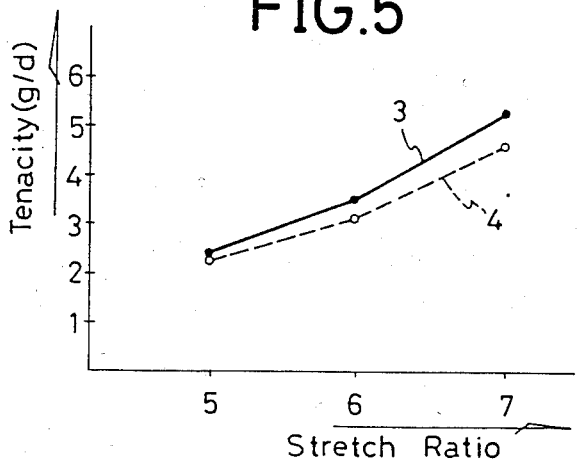
FIG. 5 shows a view illustrating the relationship between the stretch ratio and tenacity of stretched yarns obtained in Example 6 and Comparative Example 5.

At the same time, as an comparative example, to a polypropylene having a melt flow rate of 4.8, a density of 0.900, an isotactic pentad ratio of boiling n-heptane-insoluble portion of 0.935 and a ratio of pentad having two different kinds of configurations of 0.018 were pelletized as in the same manner as in Example 6. Using the resulting pellets, fibers were prepared in the same manner as in Example 6. The characteristic values of the fibers are shown in Table 3 as Comparative Example 5. Further, the results of Table 3 are also shown in FIG. 4 and FIG. 5 wherein numeral 3 shows the case of Example 6 and numeral 4 shows that of Comparative Example 5. (stretch ratio: 6 times in both the cases)

Referring to Table 3 and FIG. 4 and FIG. 5, the fibers of the present invention have a less percentage heat shrinkage than that of Comparative example, and particularly from FIG. 4 it is observed that as the temperature becomes higher, a notable difference in the heat-shrinkability is observed. Further, in FIG. 5, improvement in the tenacity is also observed.

TABLE 3

| Example and Compar. ex. | Spinnability and Stretchability | Stretch ratio Times | Characteristic values of fibers: Denier d | Tenacity g/d | Elongation % | 10% Young's modulus g/d | Percentage heat shrinkage (%): 100° C. | 120° C. | 130° C. | 140° C. | 150° C. |
|---|---|---|---|---|---|---|---|---|---|---|---|
| Example 6 | good | 5 | 5.04 | 2.42 | 29 | 22.8 | 1.5 | 1.9 | 4.4 | 5.8 | 10.6 |
| | | 6 | 4.21 | 3.63 | 24 | 31.2 | 1.8 | 2.1 | 4.5 | 6.0 | 11.5 |
| | | 7 | 3.63 | 5.31 | 19 | 44.7 | 1.9 | 2.6 | 4.5 | 6.5 | 13.3 |

TABLE 3-continued

| Example and Compar. ex. | Spinnability and Stretchability | Stretch ratio Times | Characteristic values of fibers: Denier d | Tenacity g/d | Elongation % | 10% Young's modulus g/d | Percentage heat shrinkage (%): 100° C. | 120° C. | 130° C. | 140° C. | 150° C. |
|---|---|---|---|---|---|---|---|---|---|---|---|
| Compar. ex. 5 | good | 5 | 5.17 | 2.37 | 37 | 21.2 | 3.6 | 6.8 | 12.2 | 15.5 | 29.1 |
| | | 6 | 4.13 | 3.16 | 28 | 28.8 | 3.6 | 7.2 | 13.0 | 17.7 | 31.0 |
| | | 7 | 3.51 | 4.75 | 23 | 39.1 | 3.7 | 8.2 | 14.0 | 20.0 | 35.5 |

EXAMPLES 7 AND 8 AND COMPARATIVE EXAMPLES 6, 7 AND 8

Example 6 was repeated except that only raw materials were varied. The resulting characteristics of percentage heat shrinkage and tenacity (stretch ratio: 6 times) are shown in Table 4.

As seen from Table 4, any fibers prepared from a polypropylene having a density less than 0.905, a polypropylene having a $P_0$ less than 0.960 and a polypropylene having a $P_2$ larger than 0.002 have a larger percentage heat shrinkage and also a less tenacity, whereas fibers prepared from polypropylene of the present invention have a less percentage heat shrinkage and an improved tenacity.

The polypropylene fibers according to the present invention have a much improved percentage heat shrinkage and also an improved tenacity, and in particular, as to the heat-shrinkability, since its effectiveness in a high temperature atmosphere is notable, if a drying step is required for carpet, etc., the fibers readily correspond to the tendency of rendering the drying temperature and speed at the step both higher; hence an advantage is observed in the aspects of maintenance of product quality and high productivity.

TABLE 4

| | Example 7 | Example 8 | Compar. ex. 6 | Compar. ex. 7 | Compar. ex 8 |
|---|---|---|---|---|---|
| MFR (g/10 min.) | 5.1 | 4.9 | 4.8 | 4.6 | 4.9 |
| Density (g/cc) | 0.910 | 0.913 | 0.900 | 0.903 | 0.902 |
| Boiling n-heptane-insoluble portion | | | | | |
| $P_0$ | 0.975 | 0.964 | 0.939 | 0.972 | 0.919 |
| $P_2$ | <0.002 | <0.002 | 0.017 | 0.006 | 0.025 |
| Percentage heat Shrinkage (%) | | | | | |
| 100° C. | 1.9 | 1.6 | 3.6 | 3.3 | 3.7 |
| 120° C. | 2.6 | 2.4 | 7.1 | 6.8 | 7.2 |
| 130° C. | 4.5 | 3.7 | 12.8 | 12.4 | 13.7 |
| 140° C. | 6.0 | 5.1 | 17.1 | 16.0 | 18.4 |
| 150° C. | 11.5 | 10.7 | 30.0 | 25.1 | 33.8 |
| Tenacity | 3.83 | 3.75 | 3.14 | 3.21 | 3.10 |

What we claim is:

1. Polypropylene fibers having an improved heat-shrinkability and tenacity, which comprises a polypropylene resin having a density of 0.905 g/cc or more, an isotactic pentad ratio of boiling n-heptane-insoluble portion ($P_0$) of 0.960 or more and a ratio of pentad having two different kinds of configurations ($P_2$), of 0.002 (0.2%) or less prepared by the process of polymerizing propylene in the presence of a catalyst prepared by reacting an organoaluminum compound or a reaction product of an organoaluminum compound with an electron donor, with $TiCl_4$, further reacting the resulting solid product with an electron donor and an electron acceptor, and them combining the resulting solid product with an organoaluminum compound and an aromatic carboxylic acid ester, the molar ratio of said aromatic carboxylic acid ester to said solid product being in the range of 0.2 to 10.0.

2. Flat polypropylene fibers according to claim 1, which have been stretched in a stretch ratio of 5.0 to 6.0 times and subjected to 5 to 40% relaxation heat treatment, and which have heat shrinkability of 2.6% or less when heated at 130° C. for 15 minutes.

3. Flat polypropylene fibers according to claim 1, which have been stretched in a stretch ratio of 5.0 to 6.0 times and subjected to 5 to 40% relaxation heat treatment, and which have heat shrinkability of 5.4% or less when heated at 140° C. for 15 minutes.

4. Flat polypropylene fibers recording to claim 1, which have been stretched in a stretch ratio or 5.0 to 6.0 times and subjected to 5 to 40% relaxation heat treatment, and which have heat shrinkability of 10.3% or less when heated at 150° C. for 15 minutes.

5. Flat polypropylene fibers according to claim 1, which have been stretched in a stretch ratio of 5.0 to 6.0 times and subjected to 5 to 40% relaxation heat treatment, and which have heat shrinkability of 18.1% or less when heated at 155° C. for 15 minutes.

6. Round polypropylene fibers according to claim 1, which have been stretched in a stretch ratio of 5 to 7 times and subjected to 5 to 40% relaxation heat treatment, and which have heat shrinkability of 4.5% or less when heated at 130° C. for 15 minutes.

7. Round polypropylene fibers according to claim 1, which have been stretched in a stretch ratio of 5 to 7 times and subjected to 5 to 40% relaxation heat treatment, and which have heat shrinkability of 6.5% or less when heated at 140° C. for 15 minutes.

8. Round polypropylene fibers according to claim 1, which have been stretched in a stretch ratio of 5 to 7 times and subjected to 5 to 40% relaxation heat treatment, and which have heat shrinkability of 13.3% or less when heated at 150° C. for 15 minutes.

9. Polypropylene fibers according to claim 1 where the density of the polypropylene is 0.910 or higher.

10. Polypropylene fibers according to claim 1, having therein a nucleus-creating agent.

11. Polypropylene fibers according to claim 1, wherein the melt flow rate is within the range of 1.0 to 7.0.

12. Polypropylene fibers according to claim 1, wherein said polypropylene resin has an isotactic pentad ratio of boiling n-heptane-insoluble portion (Po) of 0.975 or more.

* * * * *